US007014542B1

(12) United States Patent
Lu

(10) Patent No.: US 7,014,542 B1
(45) Date of Patent: Mar. 21, 2006

(54) CUTTER FOR CUTTING AND GRINDING OPTICAL LENS IN A SINGLE PROCESS

(76) Inventor: Po Wen Lu, No. 28, Lane 80, Dasin Road, Tanzih Township, Taichung County 427 (TW)

( * ) Notice: Subject to any disclaimer, the term of this patent is extended or adjusted under 35 U.S.C. 154(b) by 0 days.

(21) Appl. No.: 11/032,122

(22) Filed: Jan. 11, 2005

(51) Int. Cl.
*B24B 7/00* (2006.01)

(52) U.S. Cl. ..... 451/65; 451/70; 451/66; 451/69; 451/461

(58) Field of Classification Search ..... 451/461, 451/69, 70, 65, 66, 262, 277, 462
See application file for complete search history.

(56) References Cited

U.S. PATENT DOCUMENTS 4,843,766 A * 7/1989 Umeda ..... 451/69
6,336,849 B1 * 1/2002 Konnemann ..... 451/259
6,905,398 B1 * 6/2005 Jeong ..... 451/57

* cited by examiner

*Primary Examiner*—George Nguyen
(74) *Attorney, Agent, or Firm*—Rosenberg, Klein & Lee

(57) ABSTRACT

A cutter foe making optical lenses has a main member with a connector base and a grinding assembly at an opposite ends thereof. The grinding assembly has two fixed devices having a cutting portion at a distal end thereof respectively and two movable devices having a grinding portion at a distal end thereof respectively. The grinding portions are finer than the cutting portions. An elastic member has opposite ends resting on the main member and the movable device to urge the movable device for movement along an axial orientation of the main member. A key is provided between the movable device and the main member to restrict the movable device from movement, whereby the grinding portion of the movable device is higher than the cutting portions of the fixed devices by the elastic member urging the movable device outward and the key fixing the movable device thereat.

4 Claims, 9 Drawing Sheets

CUTTER FOR CUTTING AND GRINDING OPTICAL LENS IN A SINGLE PROCESS

BACKGROUND OF THE INVENTION

1. Field of the Invention

The present invention relates generally to a tool of making lens, and more particularly to a cutter, which grind and cut lens in a single process.

2. Description of the Related Art

In a process of making an optical lens, the glass is molten and molded into a raw lens, and then a spherical cutting machine is applied to cut the raw lens, and a grinding machine is applied to rough grind and fine grind the lens. As shown in FIG. 8, the conventional spherical cutting machine has a reciprocating and rotary clamping device 7 and a hollow cutter 71. The clamping device 7 is clamped with a holder 72, on which lenses 9 are held. The cutter 71 has a grindstone 73 at a bottom thereof, which has grains with various roughnesses, according to the requirement of process, on a surface thereof and rests on the lenses 9. The grindstone 73 of the cutter 7 cuts the lenses 9 held on the holder 72 into spherical lenses.

After processed by the spherical cutting machine, the lenses 9, with the holder 72, are moved to a sand falling machine to rough grind the lenses 9 by a container 8, as shown in FIG. 9A. The container 8, which has a plurality of smoothing metal pellets 81, is swung to grind the lenses 9, which the holder 7 is rotated, by the smoothing metal pellets 81. The lenses 9 are grinded for the first rough grinding step. And then, the lenses 9, with the holder 7, are moved to another container 82, as shown in FIG. 9B, for the second grinding step. The container 82 has a plurality of smoothing resin pellets 83 to grind the lenses 9 having a predetermined curvature.

Because of the roughness of grindstone 73 of the cutter 71 and the pellets 81 and 83 of the containers 8 and 82 are constant, the lenses cannot be cut and grinded in a single machine, so that the lenses have to be moved between two independent machines for cutting and grinding procedures respectively, and it makes the process of making the lenses complex. It gets more complex when the lenses have to be polished. As shown in FIG. 10, the lenses have to be moved to the third container for the extra grinding procedure.

It is urgent to find a solution to simplify the procedures of making the lenses and to lower the cost of fabrication.

SUMMARY OF THE INVENTION

The primary objective of the present invention is to provide a cutter, which cuts and grind the lenses in a single procedure. A cutter of the present invention comprises a main member having a connector base at an end thereof to connect a cutting apparatus thereon and a grinding assembly at an end thereof opposite to the connector base. The grinding assembly has two fixed devices having a cutting portion at a distal end thereof respectively and at least a movable device neighboring the fixed devices having a grinding portion at a distal end thereof. The grinding portion is finer than the cutting portions, and the fixed devices and the movable device are arranged for a circular pattern. An elastic member has opposite ends resting on the main member and the movable device to urge the movable device for movement along an axial orientation of the main member. A key is provided between the movable device and the main member to restrict the movable device from movement, whereby the grinding portion of the movable device is higher than the cutting portions of the fixed devices by the elastic member urging the movable device outward and the key fixing the movable device thereat.

The second objective of the present invention is to provide a cutter, which the movement of the movable device is adjustable to adjust the feed thereof that facilitate the process of rough grinding.

The third objective of the present invention is to provide a cutter, which one of the movable devices has a finer grinding level, and the distance of movement of the movable device is greater than that of another movable device. This provides the movable device to perform a finer polishing procedure that provides the lenses being cut, rough grinded and polished in a single procedure.

DETAILED DESCRIPTION OF THE INVENTION

As shown in FIG. 1 to FIG. 4, a cutter for cutting and grinding a lens of the first preferred embodiment of the present invention comprises a main member 1, on an end of which a grinding assembly is provided. The grinding assembly has at least a fixed device 2 and at least a movable device 3, wherein the movable device is urged by an elastic member 32 to reciprocate in a predetermined distance.

Figure 1:
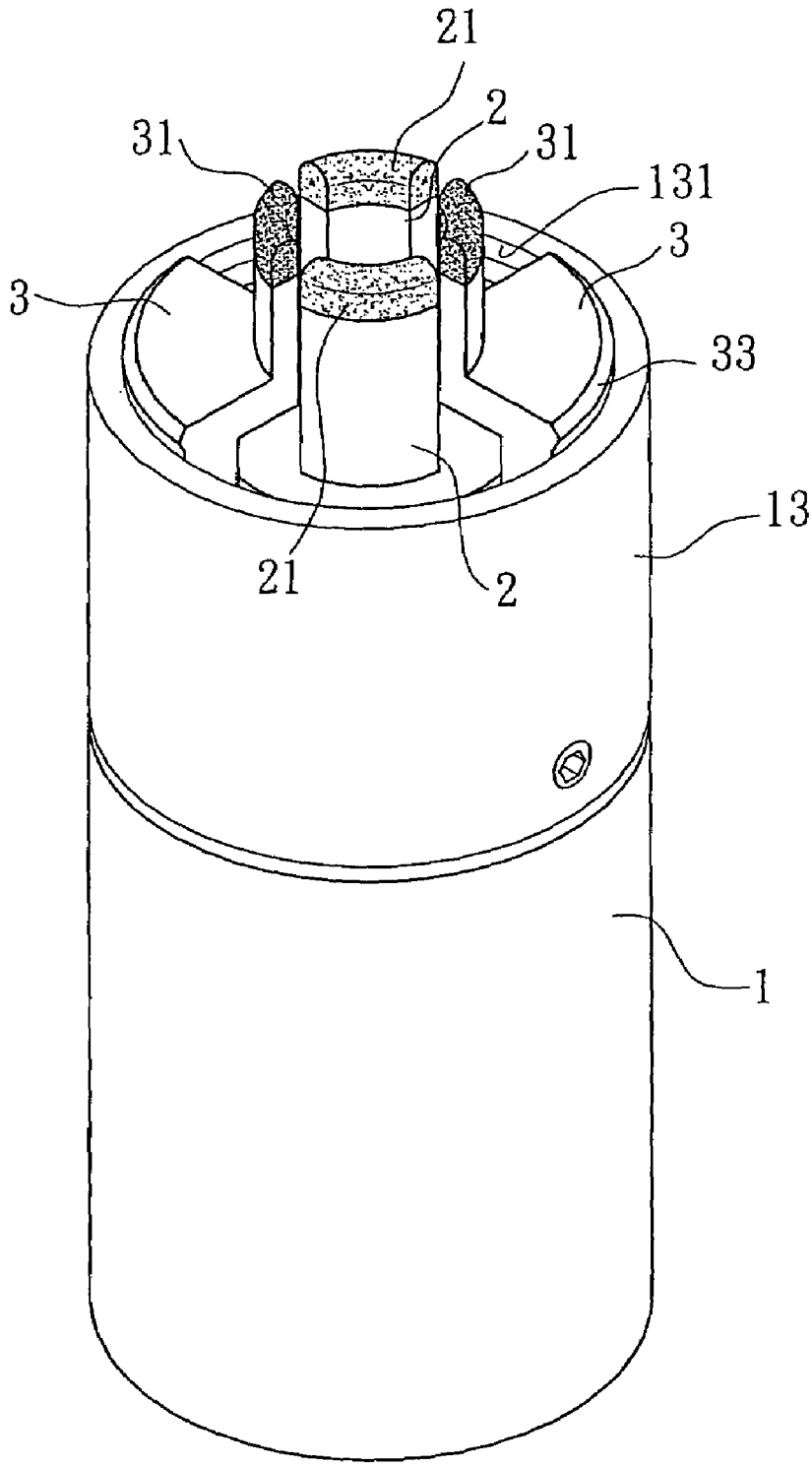
FIG. 1 is a perspective view of a first preferred embodiment of the present invention.
Figure 2:
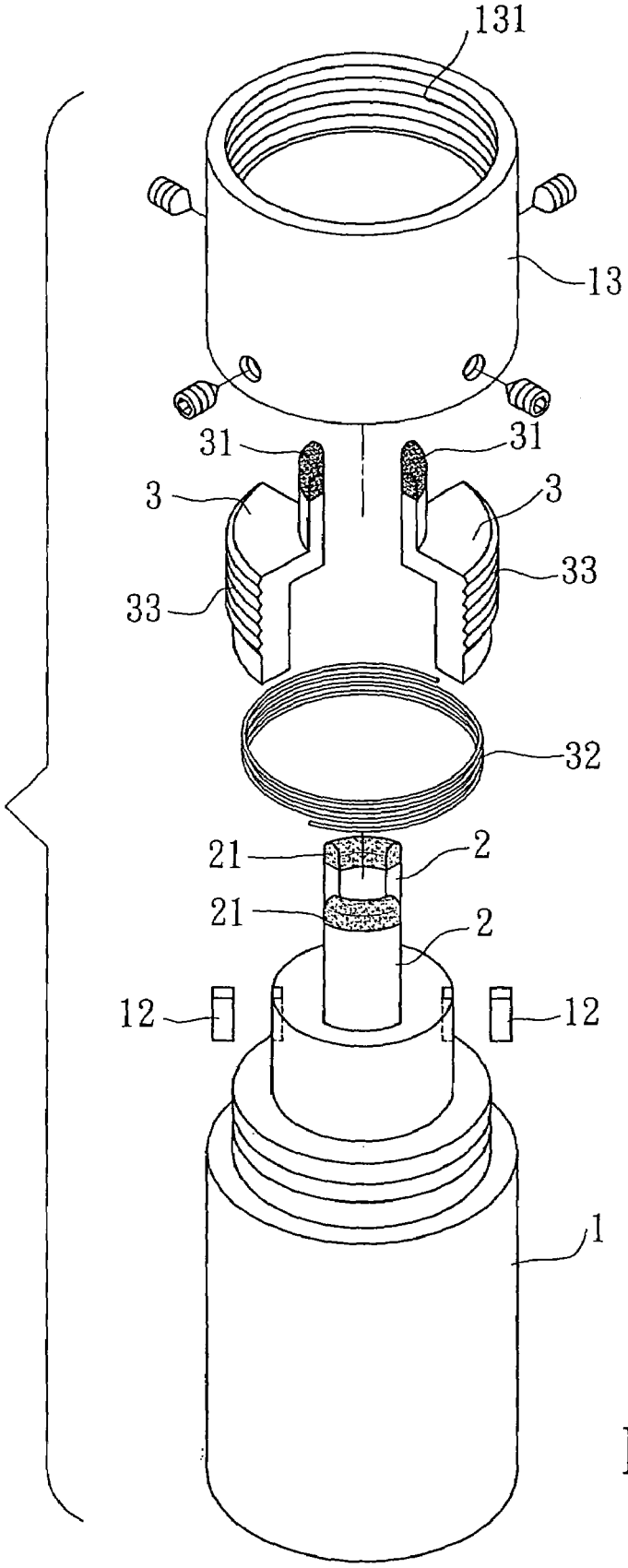
FIG. 2 is an exploded view of the first preferred embodiment of the present invention.
Figure 3:
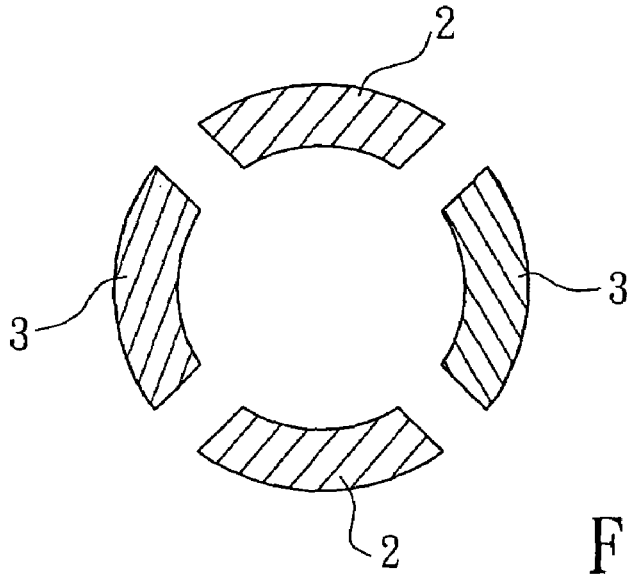
FIG. 3 is a sectional view of the first preferred embodiment of the present invention, showing the relationship of the fixed device and the movable device.
Figure 5:
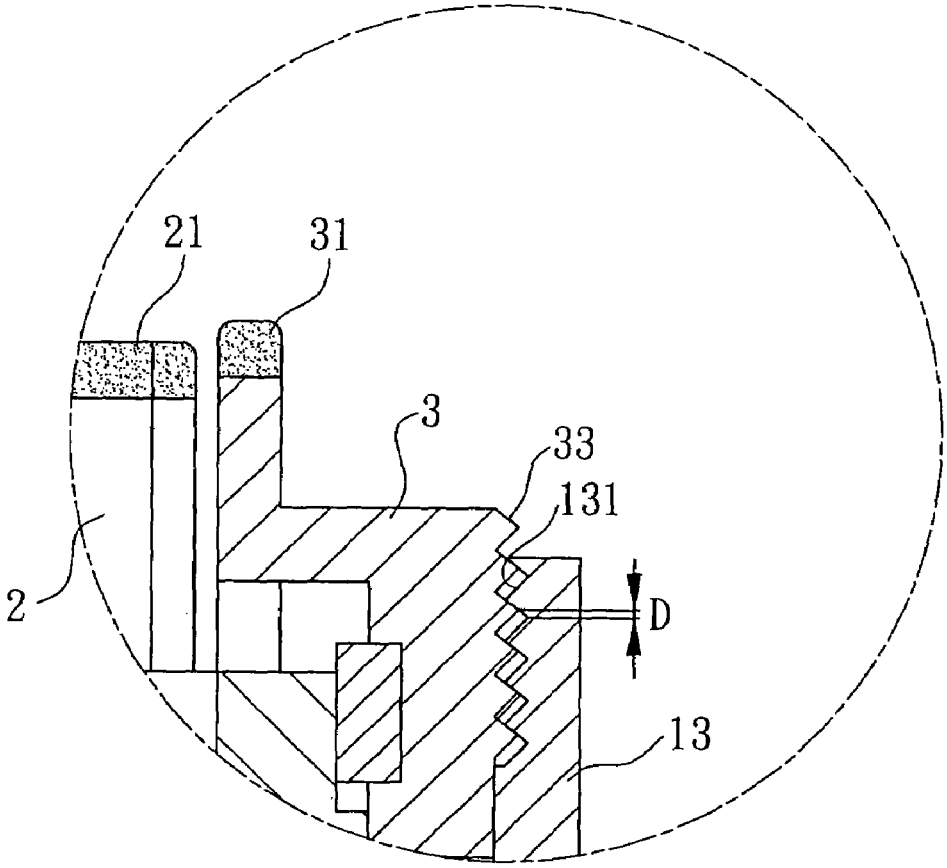
FIG. 5 is a sectional view in parts of the first preferred embodiment of the present invention, showing the movement of the movable device.
Figure 4:
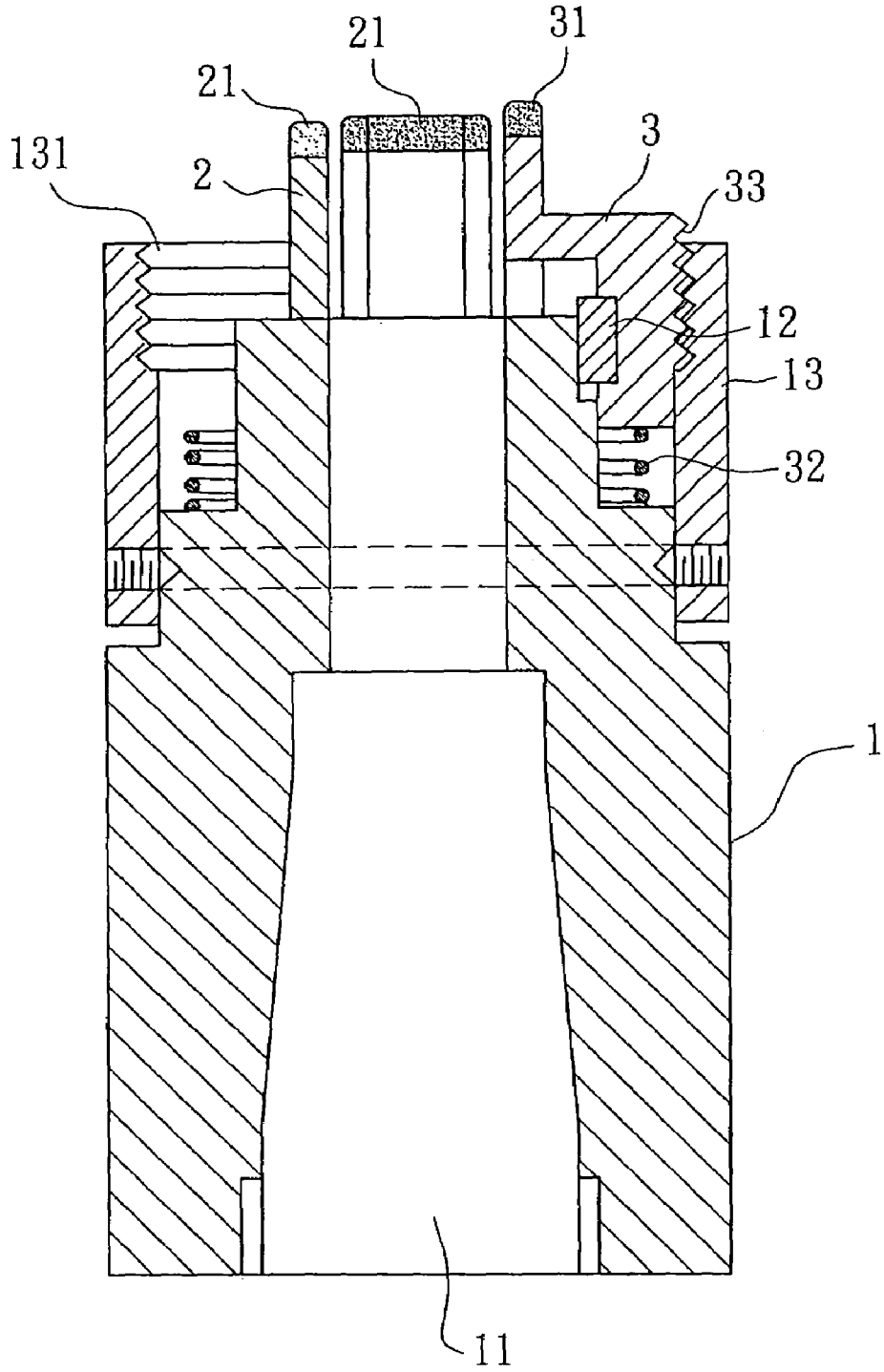
FIG. 4 is a sectional view of the first preferred embodiment of the present invention.

The main member 1 has a connector base 11 at an end thereof to connect a cutting apparatus (not shown). The main member 1 is fixed with two of the fixed devices 2 at an end thereof opposite to the cutting apparatus, and two of the movable devices 3 are provided to the main member 1 neighboring to the fixed devices 2. Each of fixed devices has a cutting portion 21 at a distal end respectively, which are made of grindstones with rougher surfaces. Each of the movable devices 3 has a grinding portion 31 at a distal end respectively, which are made of grindstone with less rough surfaces. The movable devices 3 are urged by the elastic member 32, which is a spring in the present preferred embodiment with opposite ends thereof rested on the movable devices at ends thereof opposite to the grinding portions 31 and on the main member 1 respectively, to reciprocate along an axial orientation of the main member 1. Two keys 12 are provided between the main member 1 and the movable devices 3 respectively to restrict the distance of reciprocation of the movable devices 3. In the present preferred embodiment, a hub 13 having an inner thread 131 is screwed to the movable devices 3 having an outer thread 33. There is a gap D between the engagement of the inner thread 131 and the outer thread 33 that provide the movable devices 3 a tolerance for reciprocation, as shown in FIG. 5.

Figure 6:
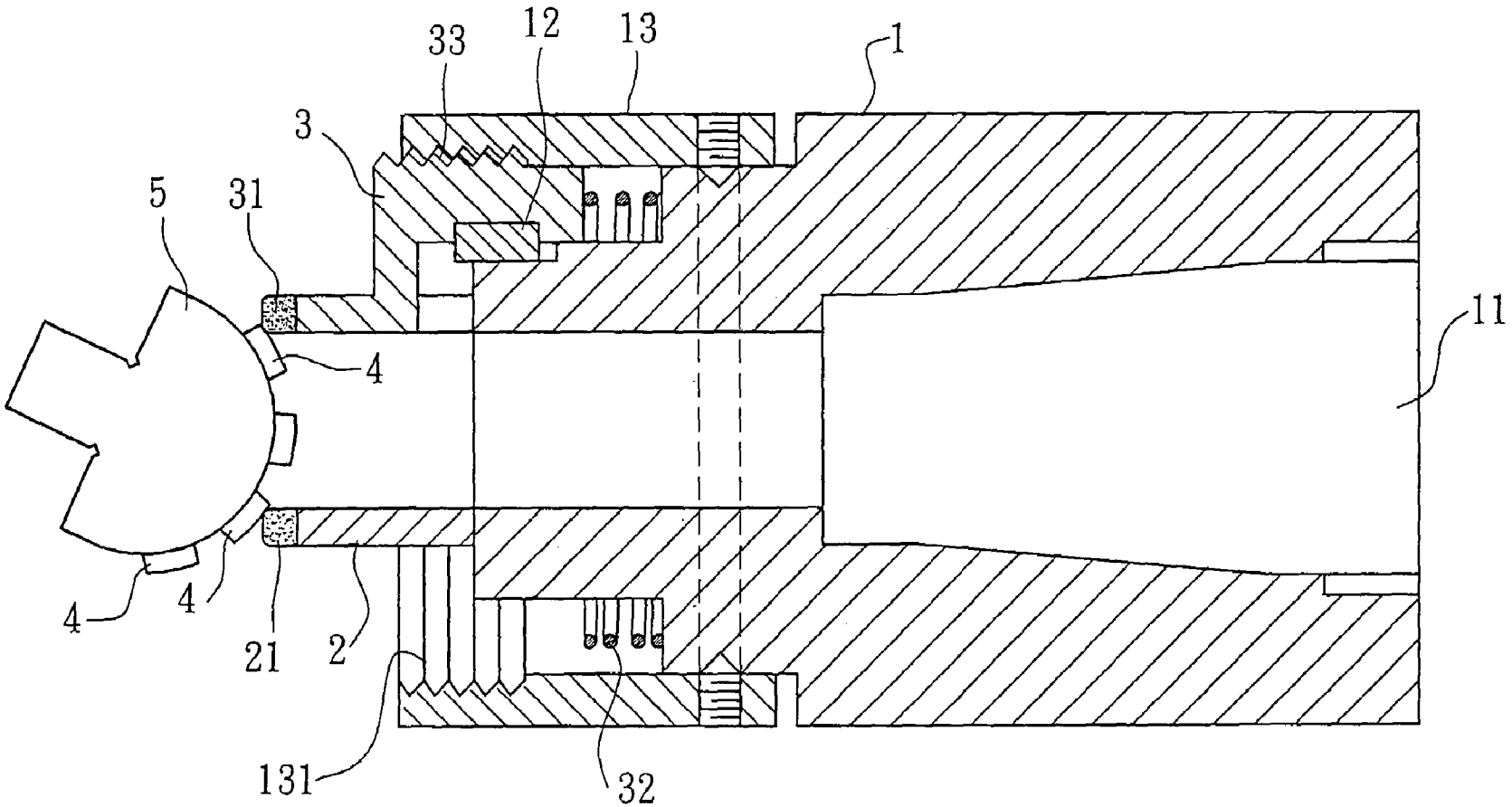
FIG. 6 is a sectional view of the first preferred embodiment of the present invention, showing it processing the lens.
Figure 6A:
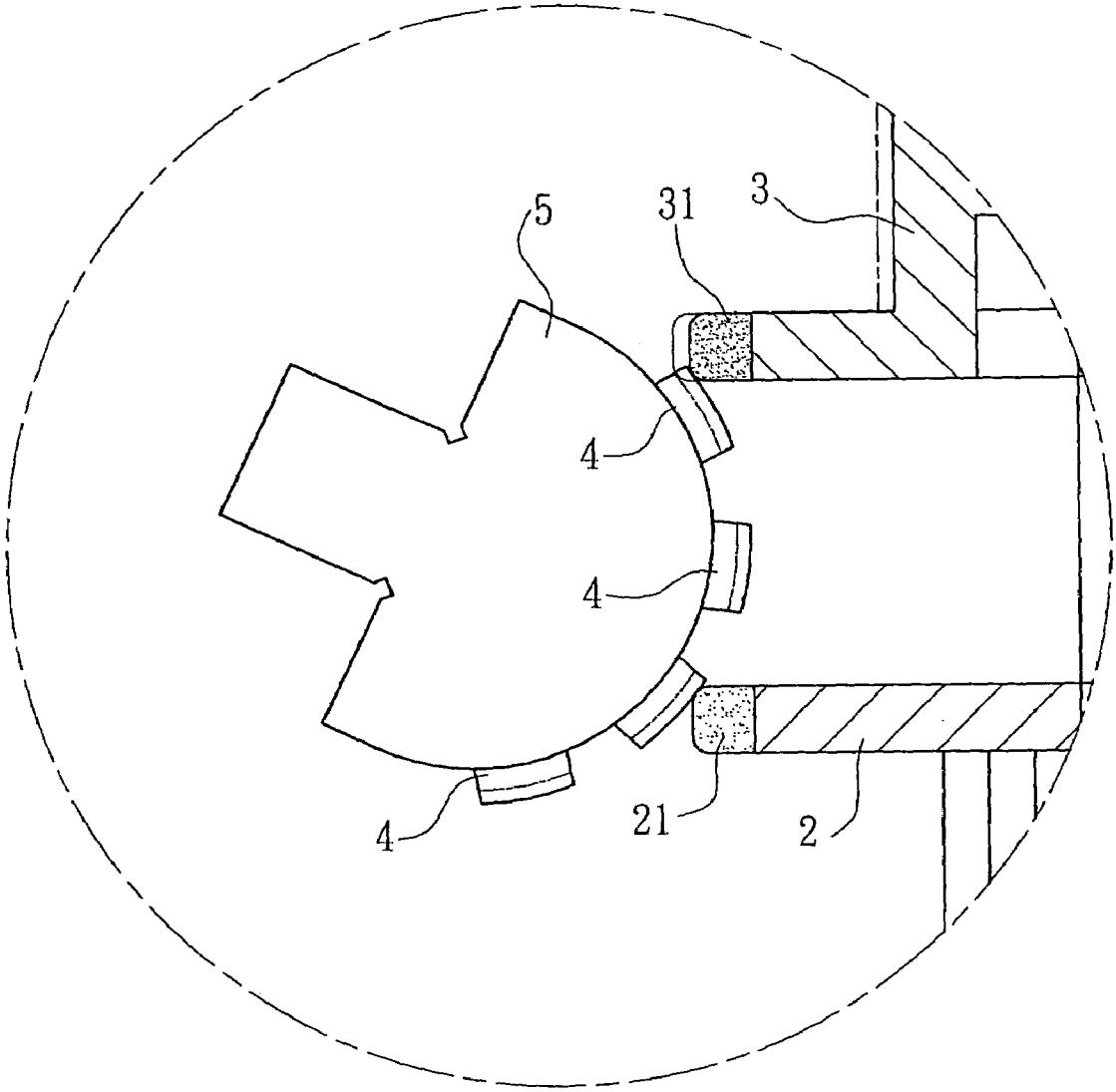
FIG. 6A is a sectional view in parts of the first preferred embodiment of the present invention, showing it cutting and grinding the lens in a single process.

As shown in FIG. 6 and FIG. 6A, raw lenses 4 are fixed at a holder 5 of the cutting apparatus, and the cutter of the present invention is moved against the lenses 4. The movable devices 3 are moved inward the main member 1 to have the grinding portions 31 thereof and the cutting portion 21 of the fixed devices 2 at same height. The holder 5 is swung and rotated, and the cutter is fed to cut the lenses 4 by the cutting portions 21 of the fixed devices 2. The lenses 4 are cut into a specific sharp according to the distance of the feed of cutter of the present invention. While the cuter of the invention stops feeding, the movable devices 3 are moved outward by the spring 32 to grind the lenses 4 by the grinding portions thereof until the movable devices 3 reach the farthest position of the reciprocation. After the grinding procedure has finished, the lenses 4 are moved to a polishing machine for continuous polishing, after that, optical lenses are completed.

The cutting portions 21 of the fixed devices 2 and the grinding portions 31 of the movable devices 3 have various roughnesses to cut and grind the lenses in a single procedure. It simplifies the procedures of the process of making the optical lenses. As a result, the capacity of production is increased, and the cost of machines is decreased.

If the gap D between the inner and outer threads 131 and 33 of the hub 13 and the movable devices 3, the distance of the movement of the movable device 3 is changed, which can adjust the rough grinding procedure.

Figure 7:
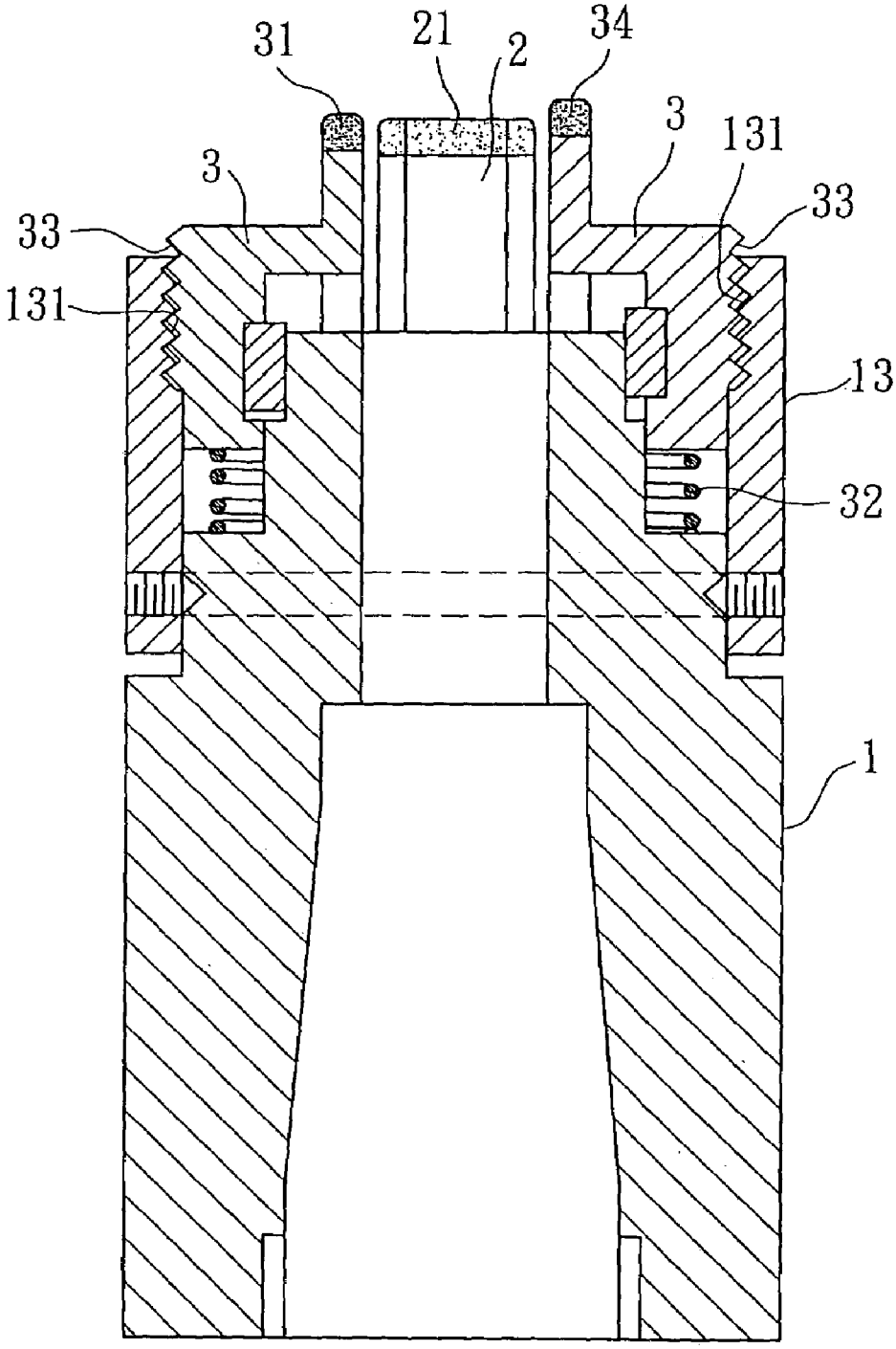
FIG. 7 is a sectional view of a second preferred embodiment of the present invention.
Figure 8:
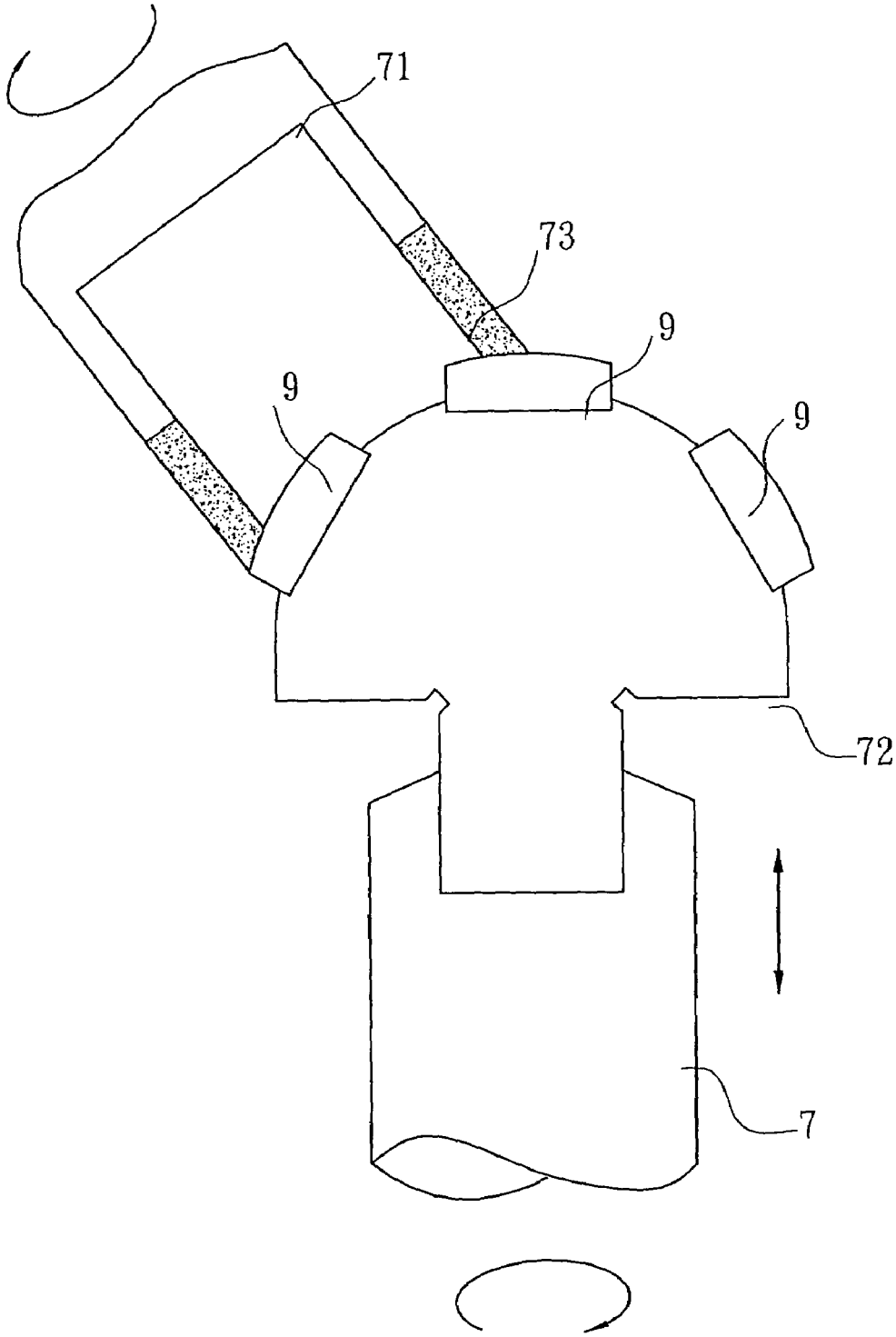
FIG. 8 PRIOR ART
FIG. 8 is a perspective view of the conventional spherical cutting machine, which cut the lenses.
Figure 9A:
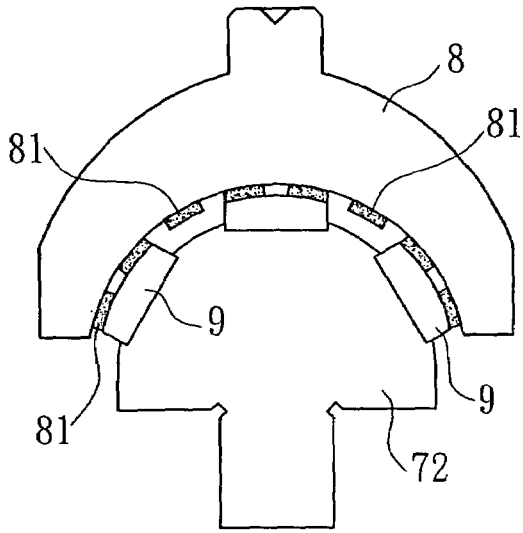
FIG. 9A PRIOR ART
FIG. 9A is a sectional view of the conventional sand falling machine, showing the container processing the rough grinding on the lenses.
Figure 9B:
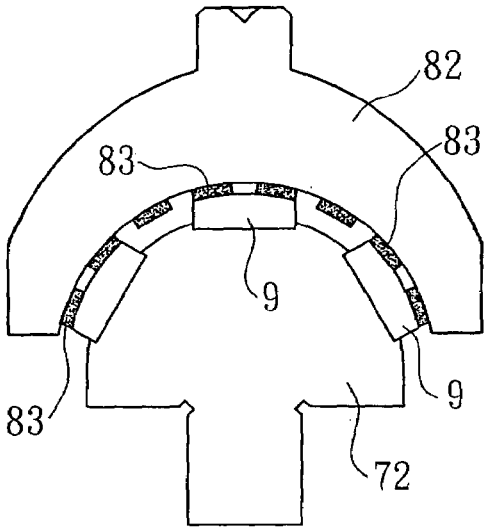
FIG. 9B PRIOR ART
FIG. 9B is a sectional view of the conventional sand falling machine, showing another container processing the fine grinding on the lenses.
Figure 10:
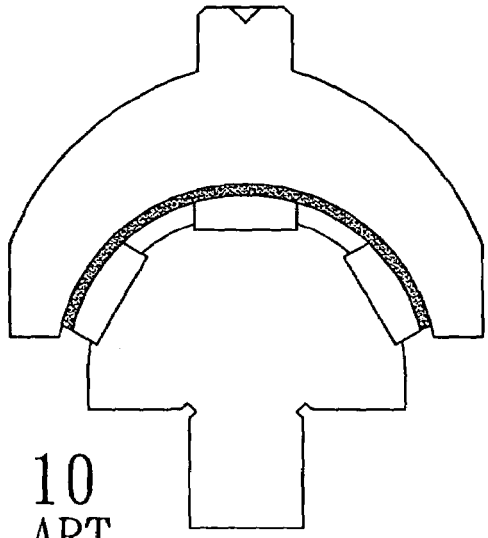
FIG. 10 PRIOR ART
FIG. 10 is a sectional view of the conventional sand falling machine, showing the third container processing the polishing on the lenses.

The cutter of the present invention can perform cutting, grinding and polishing in a single process as well. As shown in FIG. 7, a cutter of the second preferred embodiment of the present invention, which is similar to the cutter of the first preferred embodiment, has a main member 1 with a connector base 11 at an end thereof, two fixed devices 2 at an end of the main member 11 opposite to the connector base 11 having a cutting portion at a distal end respectively, and two movable devices 3, on of which has a grinding portion 31, and another of which has a polishing portion 34. The polishing portion is finer than the grinding portion 31. The gap between an outer thread 33 of the movable device 3 with the polishing portion 34 and an inner thread 131 of a hub 13 is greater than that of between an outer thread 33 of the movable device 3 with the grinding portion 31 and the inner thread 131 of the hub 13, so that a distance of movement of the movable device 3 with the polishing portion 34 is greater than that of the movable device 3 with the grinding portion 31. The lenses 4 are grinded by the grinding portion 31 of the movable device 3, and then the lenses 4 are polished by the polishing portion 34 of the movable device 3. As a result, the cutter of the second preferred embodiment of the present invention performs the cuts, grinding and polishing procedures in a single process.

What is claimed is:

1. A cutter for making an optical lens, comprising a main member having a connector base at an end thereof to connect a cutting apparatus thereon and a grinding assembly at an end thereof opposite to the connector base; wherein the grinding assembly has two fixed devices having a cutting portion at a distal end thereof respectively and two movable devices neighboring to the fixed devices having a grinding portion at distal ends respectively, and the grinding portions are finer than the cutting portions, and the fixed devices and the movable devices are arranged for a circularity; an elastic member having opposite ends resting on the main member and the movable devices to urge the movable devices for movement along an axial orientation of the main member; a key provided between the movable device and the main member to restrict the movable device from movement, whereby the grinding portions of the movable devices are higher than the cutting portions of the fixed devices by the elastic member urging the movable devices outward and the key fixing the movable device thereat.

2. The cutter as defined in claim 1, wherein the elastic member is a spring.

3. The cutter as defined in claim 1, further comprising a hub having an inner thread to be engaged with outer threads of the movable devices, wherein there is a gap between the inner thread of the hub and the outer threads of the movable devices that allow the movable device to move.

4. A cutter for making an optical lens, comprising a main member having a connector base at an end thereof to connect a cutting apparatus thereon and a grinding assembly at an end thereof opposite to the connector base; wherein the grinding assembly has two fixed devices having a cutting portion at a distal end thereof respectively and two movable devices neighboring to the fixed devices, one of which has a grinding portion at a distal end, and the other of which has a polishing portion at a distal end thereof respectively, and the grinding portion is finer than the cutting portions, the polishing portion is finer than the grinding portion, and the fixed devices and the movable devices are arranged for a circularity; an elastic member having opposite ends resting on the main member and the movable devices to urge the movable devices for movement along an axial orientation of the main member; a key provided between the movable device and the main member to restrict the movable device from movement, whereby the grinding portions of the movable devices are higher than the cutting portions of the fixed devices by the elastic member urging the moveable devices outward and the key fixing the movable device thereat.

* * * * *